US005316534A

United States Patent [19]

Dalebout et al.

[11] Patent Number: 5,316,534

[45] Date of Patent: May 31, 1994

[54] MULTIPURPOSE EXERCISE MACHINE

[75] Inventors: William T. Dalebout, Logan; Ken C. Jones, Hyde Park, both of Utah

[73] Assignee: Proform Fitness Products, Inc., Logan, Utah

[21] Appl. No.: 835,783

[22] Filed: Feb. 14, 1992

[51] Int. Cl.[5] ..... A63B 21/00

[52] U.S. Cl. ..... 482/133; 482/130; 482/137; 482/138

[58] Field of Search ..... 482/92, 94, 97, 98-103, 482/112-113, 121, 129-130, 133, 135-138

[56] References Cited

U.S. PATENT DOCUMENTS

| | | | |
|---|---|---|---|
| 3,588,101 | 6/1971 | Jungreis | 482/97 X |
| 3,638,941 | 2/1972 | Kulkens | 482/130 X |
| 3,902,717 | 9/1975 | Kulkens | 482/130 |
| 4,275,882 | 6/1981 | Grosser et al. | 482/112 |
| 4,426,077 | 1/1984 | Becker | 482/92 |
| 4,627,614 | 12/1986 | de Angeli | 482/97 |
| 4,643,420 | 2/1987 | Riley et al. | 482/130 |
| 4,650,185 | 3/1987 | Cartwright | 482/97 |
| 4,856,775 | 8/1989 | Colledge et al. | 482/130 X |
| 4,863,161 | 9/1989 | Telle | 482/97 |
| 4,911,436 | 3/1990 | Lighter | 482/138 X |

FOREIGN PATENT DOCUMENTS

| | | | |
|---|---|---|---|
| 2707550 | 8/1978 | Fed. Rep. of Germany | 482/133 |
| 3541980 | 6/1987 | Fed. Rep. of Germany | 482/130 |
| 242563 | 2/1987 | German Democratic Rep. | 482/133 |
| 8005681 | 5/1982 | Netherlands | 482/138 |

*Primary Examiner*—Robert Bahr

*Attorney, Agent, or Firm*—Trask, Britt & Rossa

[57] ABSTRACT

An exercise machine has a plurality of stations each having an operating device for performance of exercise by a user. At least the operating device is connected by a cable to a connection system which is further connected to a resistance mechanism having a lever with a pair of gas shock absorbers moveably secured to the lever along the length of the lever. A motor and screw vary the connection of the shocks to the lever.

13 Claims, 7 Drawing Sheets

MULTIPURPOSE EXERCISE MACHINE

BACKGROUND OF THE INVENTION

1. Field

This invention pertains to exercise equipment. It is particularly directed to multipurpose machines of the type which have a plurality of exercise stations and which provide a compact multi-function weight training exerciser.

2. State of the Art

Multi-function weight training exercise machines of various types are commercially available. Representative such machines are disclosed, for example, by U.S. Pat. Nos. 4,697,809; 4,809,972 and 4,964,632. Each of these machines combines a plurality of stations at which a user may exert effort against a resistance. Each station is structured to provide access to one or more exercise units. Each such unit is designed to involve different muscle groups in a specific exercise. A design objective for machines of this type is the provision of reliable and repeatable user adjustment of the resistance level at each exercise unit. Another important consideration is the amount of changeover time required for a user to move from one routine to another utilizing the same resistance source.

Certain machines rely upon a weight stack to provide resistance, as shown by U.S. Pat. No. 4,964,632. Resistive force is adjusted by varying the number of individual weights included in the portion of the stack which is lifted. Considerable time and effort may be required to adjust the number of weights incorporated into the moving portion of the stack. Lifting of the weights is accomplished from a selected station by means of a cable and pulley system. One such station includes a pivoted handlebar lever, the rest position of which is adjustable to accommodate various types of exercises with the expenditure of minimal changeover time. Another station is provided with a leg exercising unit comprising a pivoted arm with padded lateral extensions. This arm functions as a second lever interconnected to the weight stack through a second system of cables and pulleys. The adjustment of the load resistance felt at the respective units is accomplished by adjusting the weight stack.

U.S. Pat. Nos. 3,840,227; 3,850,431; 3,905,599 and 4,390,179 disclose exercise devices arranged so that a stack of weights may be lifted by any one of a number of mechanisms, thereby affording a user a selection of different exercises. In each of these devices, the weights are lifted directly by a cable so that the full weight of a weighted carriage is applied to the cable. U.S. Pat. No. 4,697,809 describes these devices as well as others of the same type, and discloses an improved cable operated device in which a downwardly biased resistance, such as a spring or weight carriage, may be lifted from various locations without the need for reconfiguring the cable system.

U.S. Pat. No. 4,809,972 discloses a simplified system in which multiple exercise devices are continuously connected to a single weight stack by a pulley and cable system which connects a single cable to the weights. The individual exercise devices are connected to one of multiple cables, each of which is tensioned when any one of the exercise devices is used. One of the cables passes over sets of floating pulleys, through which are reeved other of the cables. The cable ends are provided with stops to prevent retracting of the cable. Thus, when any exercise unit is operated, the other cables in the system are placed into tension. Additional exercise units can be incorporated by the use of floating pulleys on a cable directly connected to another exercise unit.

SUMMARY OF THE INVENTION

The present invention provides a multipurpose exercise machine in which cables and pulleys are arranged in a system within and in association with a support structure. The cable/pulley system functions to distribute a resistance from a resistance source to a plurality of exercise stations. The stations are located at different elevations and/or orientations to provide access to different exercise units. Exercises of different types may be performed using a single exercise unit accessible from different stations.

As is well known, the relative amounts of preferred resistance appropriate for specific exercises differ. Accordingly, the cable/pulley system is constructed and arranged to apply a selected mechanical advantage between the resistance source and each exercise unit. For example, the mechanical advantage applied between an overhead pull bar and the resistance source may be unity (a mechanical advantage of one). That is, the "load resistance" felt by a user at the pull bar would be identical to the "source resistance" developed at the resistance source. The mechanical advantage between a press bar fixture and the resistance source might be one-half, so that the load resistance felt at that unit would be approximately double the source resistance. The mechanical advantages effective at other exercise units may be any convenient multiple (either greater or less than unity) of the source resistance.

The cable/pulley system of this invention could be useful with any of the resistance sources usable in multipurpose exercise machines generally. As presently envisioned, however, it is most desirably associated with an adjustable resistance source, preferably one in which the source resistance can be adjusted without direct user interaction, as is required with weight stacks. One approach to resistance adjustment favored for this invention and not taught in the art involves altering the geometric configuration of the source structure. Such a mechanism is readily automated, and can be driven by a simple user-actuated electronic control system.

Certain embodiments of the cable/pulley machine include a control console which is positionable for observation and operation by the user at different stations as desired. A user can operate controls at the console to adjust the load resistance of any exercise unit without the need for any reconfiguration of the exercise unit or the cable/pulley system. The console may also display data and monitor progress in forms compatible with similar consoles commonly present on other types of exercise machines.

One form of adjustable resistance source contemplated for use with this invention comprises a mechanism including a pivoting member to which a cable is attached. The source resistance is that felt (measurable) in that cable when the cable is placed into tension to displace the attachment point. The source mechanism is constructed and arranged such that simple geometric reconfigurations increase or decrease the effort required to displace the attachment point. The presently preferred mechanisms are structured as simple first, second or third degree levers in which the mechanical advantage is adjustable by selectively changing the lengths of either or both of the lever arms.

A presently preferred adjustable resistance source mechanism utilizes one or more movably mounted resistance cylinders as the resistance or weight component of a simple second degree lever. Cylinders offer a considerable overall weight advantage and occupy significantly less space. Specifically, one or more such cylinders, ideally gas shock cylinders, may be pivotally anchored at a proximal end to a frame member. The distal end of the cylinder is then movably associated with a pivoting lever member cantilevered from a pivot connection which serves as the fulcrum. A cable fixture, such as a clamp or pulley, is carried by the lever member opposite the connection of the cylinder(s) with respect to the fulcrum. An amount of force must be applied to the fixture to overcome the resistance of the cylinder. The magnitude of this resistance force may be adjusted by moving the location along the surface of the curved portion or member of the cantilevered lever member at which the distal end of the cylinder is connected. This movement may be manually effected, but is more desirably achieved mechanically or electromechanically, for example through a screw drive motor. In any event, the cable fixture serves as the output mechanism of the resistance source comprising the cylinder(s).

A notable characteristic of this invention is the distribution of predictable set resistances ("Weights") at specified cable travels. This characteristic results from the use of sets of traveling pulleys as required in the system. While the pulleys distribute either the source resistance (W) or a multiple (f.W) of the source resistance to each exercise unit, the cable/pulley system assures that the cable travel (d) at each station is balanced to the cable travel (t) permitted at the source to effect a complete resistance operation, such as the stroke of a cylinder.

The user may adjust the resistance felt at any exercise unit by either adjusting the source resistance or by adjusting the leverage applied by the exercise unit to the nominal load resistance. The respective load resistances are generally set at nominal values which reflect a normal distribution. Individual adjustments to those values accommodate the special needs of individual users.

The entire cable/pulley system and resistance source mechanism may conveniently be assembled within an envelope shaped and dimensioned to accommodate a narrow profile support structure. The exercise units associated with any particular station may be collapsed when not in use. Accordingly, the multipurpose exercise machines of this invention require relatively little storage space.

BRIEF DESCRIPTION OF THE DRAWINGS

In the drawings, which illustrate what is presently regarded as the best mode for carrying out the invention.

DESCRIPTION OF THE ILLUSTRATED EMBODIMENTS

Figure 1:
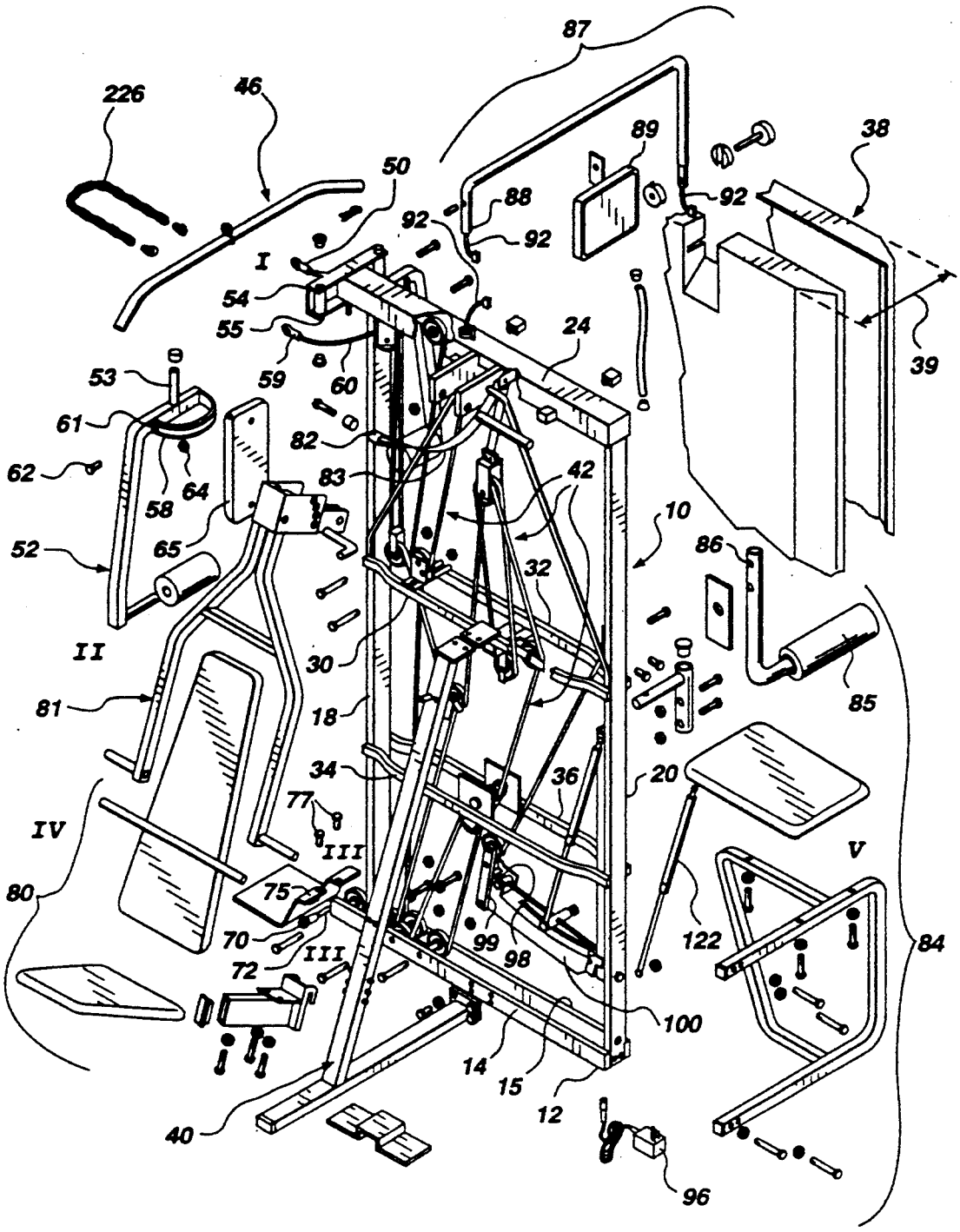
FIG. 1 is an exploded view of a multipurpose exercise machine embodying the invention.

A support frame, designated generally 10, includes a base channel member 12, which includes a pair of spaced apart parallel axle support rails 14, 15. First 18 and second 20 vertical support members extend from attachment to the base 12, and are connected at their uppermost ends to an upper support member 24. The members 18 and 20 are illustrated as approximately vertical, and the member 24 is shown as approximately horizontal. This arrangement, while typical, is optional. Other configurations may be used so long as the frame functions to support the other related components.

Intermediate mounting supports 30, 32, 34 and 36 extend between the vertical support members 18 and 20 as shown. The supports 30, 32, 34 and 36 constitute means for anchoring internal components of the machine as well as the cowling 38, a fragment of which is shown. The frame 10 with the cowling 38 when assembled have a relatively narrow width 39 to facilitate storage and to minimize the space required for the machine. A buttress support 40 extends away from the frame 10 to provide a larger footprint and in turn stabilize the frame 10.

Several stations may be located strategically about the frame of the multipurpose exercise machines of the invention. Each station is a location from which a user may access one or more exercise units (devices) connected to one or more cables included within the cable/pulley system of the machine. A typical cable/pulley system is designated generally 42 in FIG. 1. The layout of this machine is better illustrated by FIGS. 2 and 3, from which may be identified five stations, designated I–V, respectively. Other embodiments may incorporate either fewer or more stations and/or exercise units. The embodiment illustrated by FIGS. 5–7, for example, accommodates three stations, each of which provides access to more than one exercise unit. In all cases, the adjustable resistance source and floating pulley arrangement described provide significant benefits.

Figure 2:
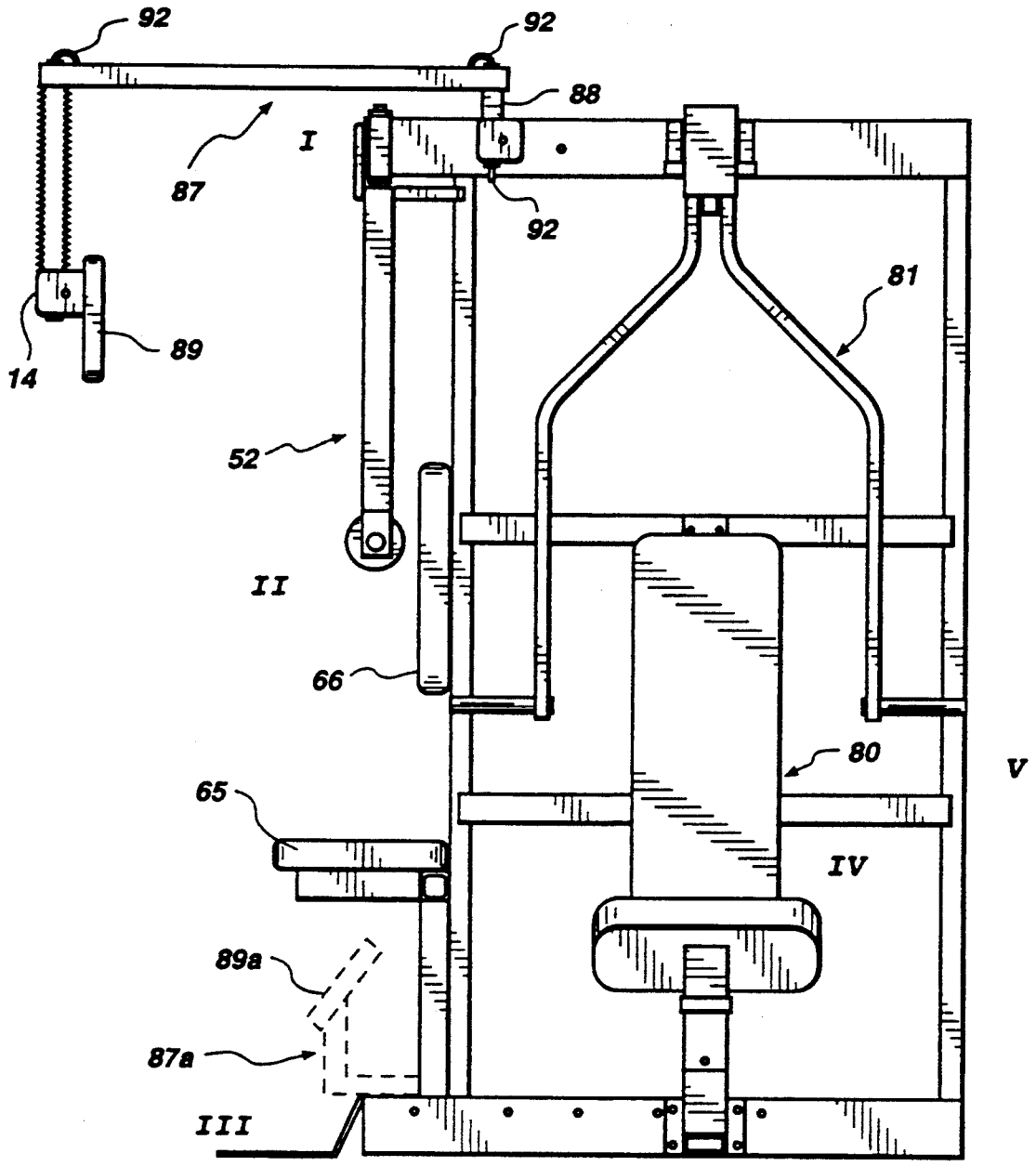
FIGS. 2 and 3 are schematic views in elevation of the embodiment of FIG. 1.
Figure 3:
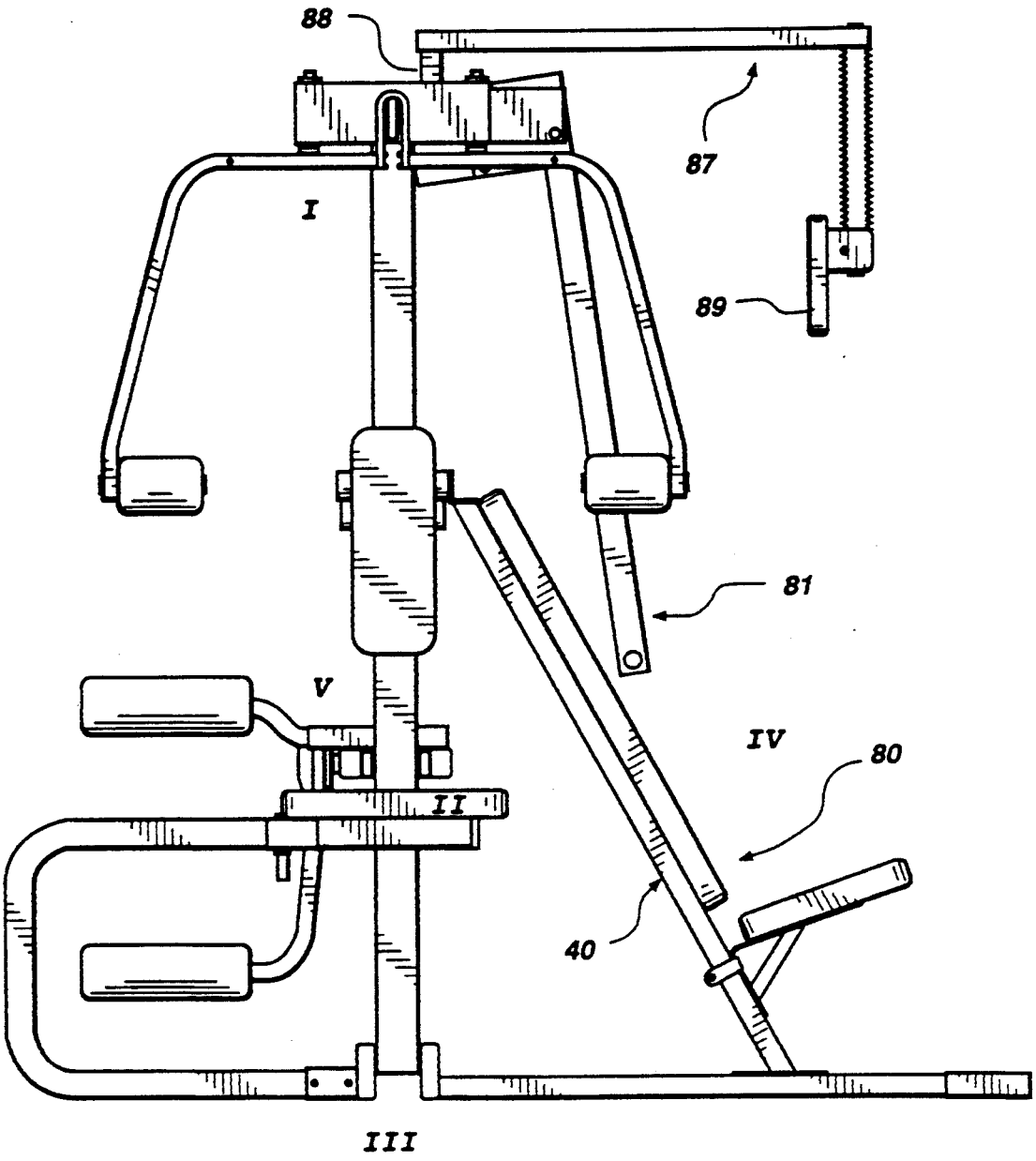

In the particular embodiment illustrated by FIGS. 1–3, from station I, a user may operate an overhead pull bar 46 attached to the cable end 50. Station II provides access to a butterfly assembly. Only the left half 52 is shown. The right half is a mirror of the left half 52 and is not shown. Left half 52 includes a pin 53 which is journaled in a bushing 54 carried by a transverse support member 55. Left half 52 further includes a cable drum 58. An end terminus fixture 59 of one of a pair of similar cables 60 is attached to the drum 58 of the left half 52 at the aperture 61 by means of a bolt 62 and nut 64. The not shown right half is configured and installed similar to the left half 52.

Station II positions the user on a seat 65 beneath station I, leaning against a backrest 66. From this station, the user also has access to any device, such as a low pull bar which is bar 46 connected to the lower cable. The user may also access a leg lift assembly (not shown), which may be connected to a terminus fixture 70 of the cable end 72.

An optional base plate 75 and fasteners 77 are shown in the vicinity of station III beneath station II. The low pull cable 72 can be operated from this station to effect rowing-type or other floor exercises using bar 46 or a shorter handle (not shown). It should be noted that the exercise units operated from station II can generally also be operated from station I to exercise different muscle groups.

An assembly, designated generally 80, may be mounted to the buttress support 40, which may then be considered station IV. A press bar exercise unit assembly 81 may be connected to a looped end 82 of a strap 83 of the system 42 for operation from station IV.

A seat assembly, designated generally 84, may be mounted to the vertical support member 20 to form station V. The user may perform static exercises using the padded bar 85. The bar 85 may also be frictionally rotated so the user may perform exercises by using the chest, arms or torso, or the like.

A control console assembly 87 is mounted as best shown by FIGS. 2 and 3 so that it may be pivoted on its support column 88. The control panel 89 is positioned at the distal end of the assembly 87. The panel 89 may include various display components and operating controls. It may be rotated to be positioned at will to be visible and operable from any of the stations I–V. Conductors 92 connect the panel 89 and its associated electronic components, within the housing 94, to an appropriate power source 96 and a screw drive motor 98, between end piece 95, left side 97A and right side 97B at the distal end 99 of the lever member 100. The assembly 87 may be rotated about its support column 88. As an alternate, an assembly **87*a* shown in phantom has a panel 89*a* positioned fixedly to the frame 10** on a corner or other location to facilitate operation by user.

Figure 4:
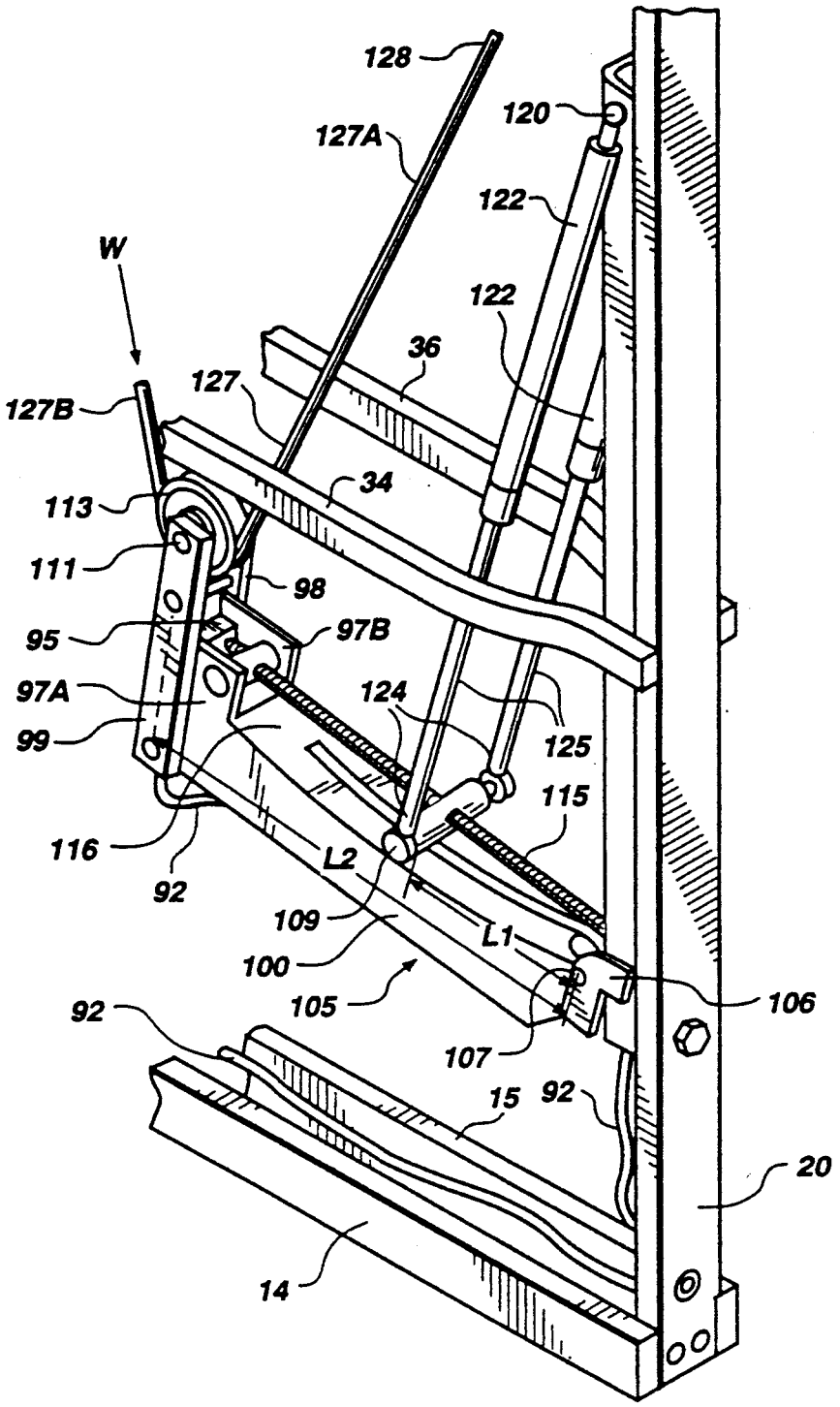
FIG. 4 is an enlarged fragmentary view of a portion of the machine of FIG. 1 showing a variable resistance source.

As best shown by FIG. 4, a resistance source, designated generally 105, comprises the cantilevered lever member 100 connected at a proximal end 106 by a pivot pin 107 to the support member 20. The pin 107 thus functions as a fulcrum for a first lever arm L1 between the pin 107 and a traveling block 109 and a second lever arm L2 between the pivot 107 and the axis 111 of a pulley 113 mounted at the distal end 99 of the lever member 100. As illustrated, the lever arm L2 is substantially constant, but lever arm L1 is adjustable in length by turning the screw 115, either clockwise or counterclockwise, either manually using a hand crank (not shown) connectable through a not shown aperture in member 20 or by means of the motor 98. The motor 98 may be energized for this purpose by a user by operating appropriate controls at the control console panel 89 or **89*a*. The proximal ends 120 of a pair of like air shock cylinders 122 are pivotally connected to the support 20. The distal ends 124 of the pistons 125 of the cylinders 122 are pivotally connected to the traveling block 109 travelling along a surface of the curved member 116. The output of the source 105 is the pulley 113, which receives a cable 127. A first end 127A of the cable 127 is anchored by an end fixture 128 to the support 20. The resistive force W developed by resistance source 105 is thus a function of the resistance of the cylinders 122, and the mechanical advantage offered by the ratio L2:L1. Of course, the angles included by the cable end 127B and the pistons 125, respectively, and the member 100 will impact upon the value of W in practice. Nevertheless, the precise nominal resistance distributed to each exercise unit in the machine can be exactly adjusted from the panel 89**.

It should be understood that alternate resistance devices may be substituted for the gas shocks 122. For example, springs, rubber elastics or any other similar resistance may be used as desired.

Figure 5:
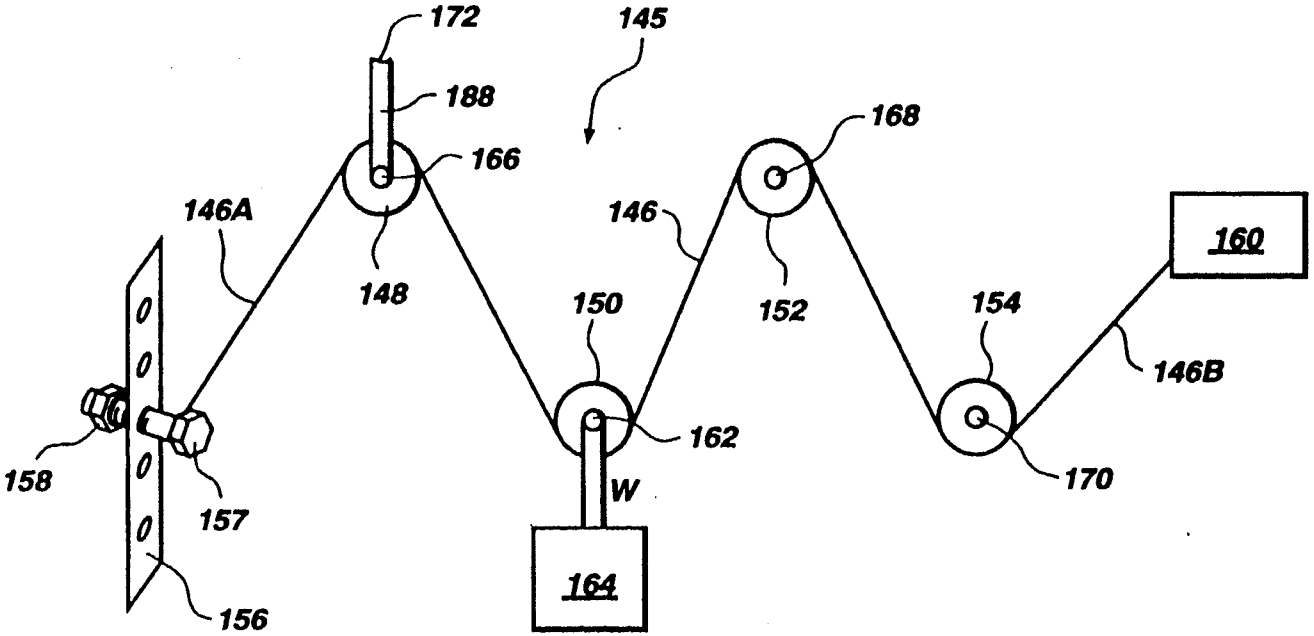
FIGS. 5 through 8 are diagrammatic illustrations of portions of a cable/pulley system of an alternative embodiment of a multipurpose exercise machine of the invention.
Figure 6:
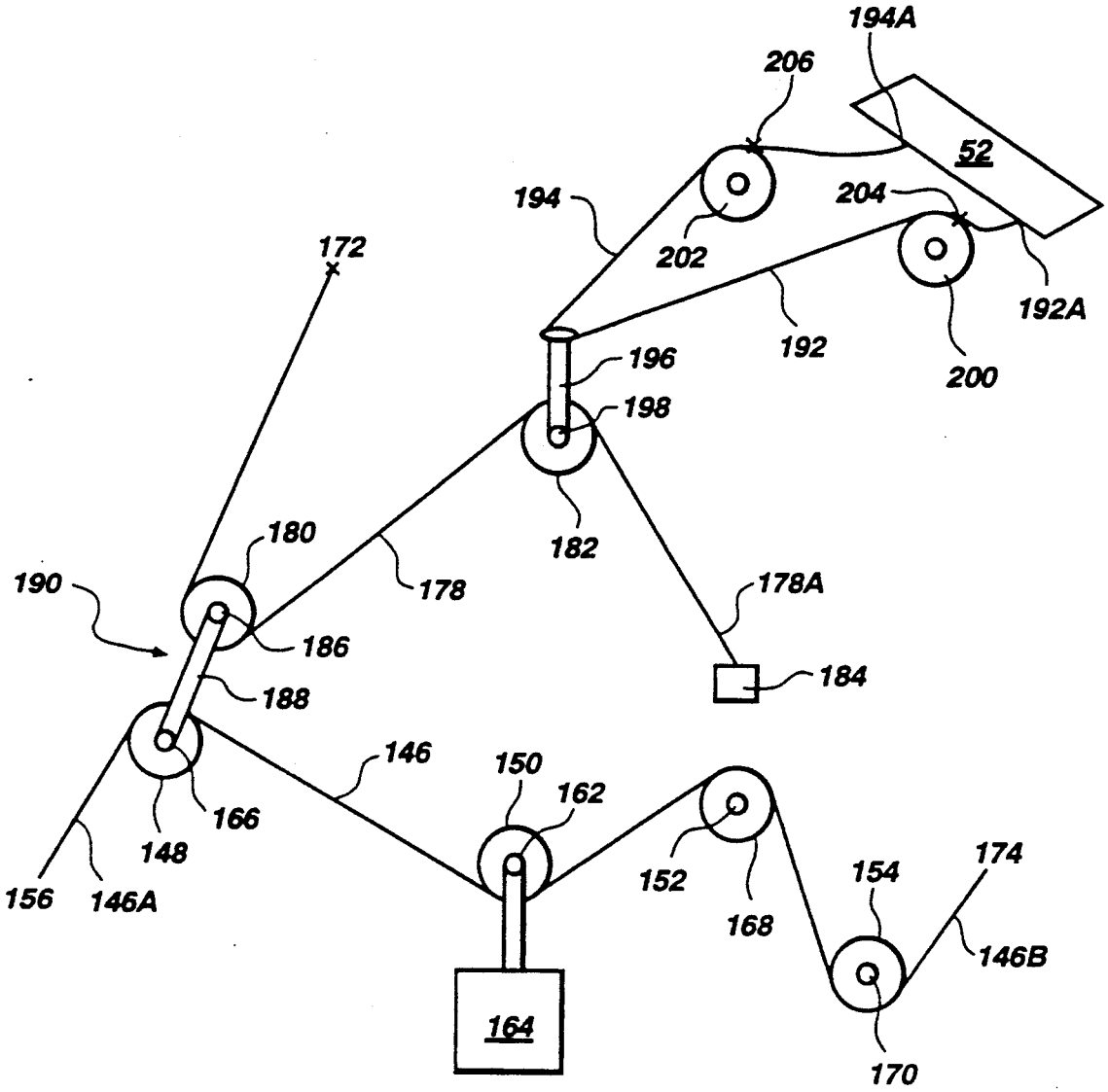

FIGS. 5 through 8 illustrate the manner in which a pulley/cable system of this invention distributes resistance in a somewhat simplified schematic. Each figure illustrates the involvement of selected cables and pulleys of the system, designated generally 145. FIG. 5 shows the manner in which a first continuous cable 146 is reeved through a series of pulleys 148, 150, 152, 154 between an adjustable anchoring fixture 156, to which it is connected at its first end 146A by a bolt 157 and nut 158, to an exercise unit 160, connected to its opposite end 146B. The illustrated arrangement is appropriate for a low pull exercise unit. The pulley 150 is connected at its axle 162 to a resistance source 164. Assuming that pulley 150 is an output device similar to the pulley 113 of FIG. 4, it will travel when the cable end 146B is pulled through operation of the unit 160. All of the other axles 166, 168, 170 in the system are stationary, although, as may be seen in FIG. 6, the axle 166 is held against movement by a remote cable stop 172. It is thus free to travel when pulled in the opposite direction. Nevertheless, with the pulleys constrained as illustrated by FIG. 6, approximately one-half the source resistance W is distributed as load resistance to the exercise unit 160.

Figure 7:
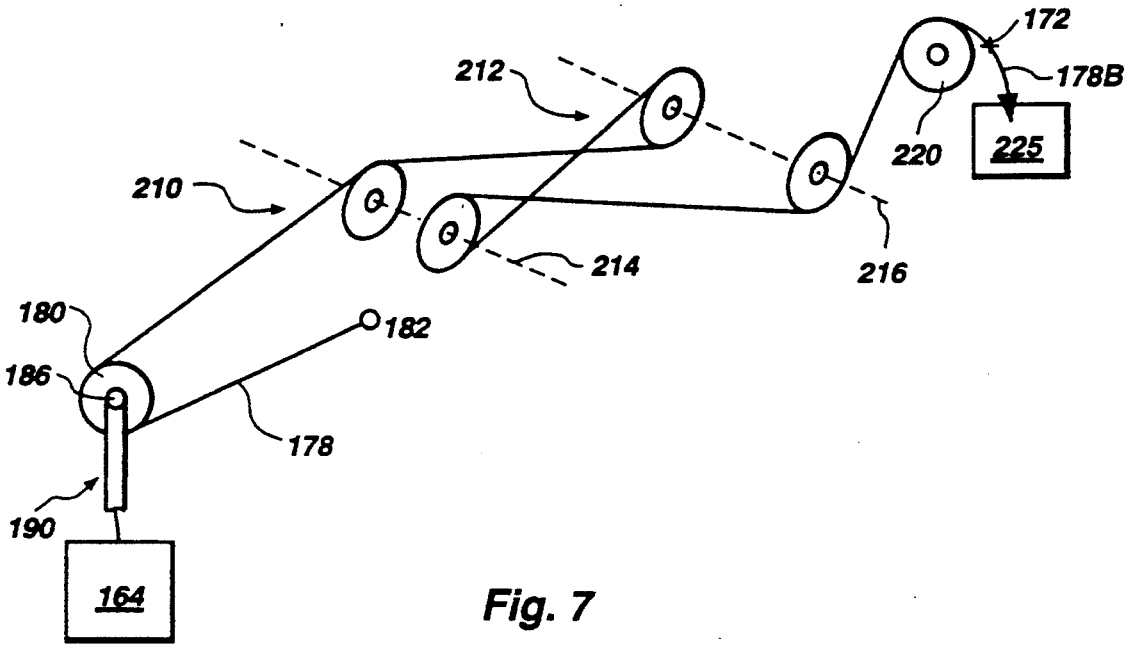
Figure 8:
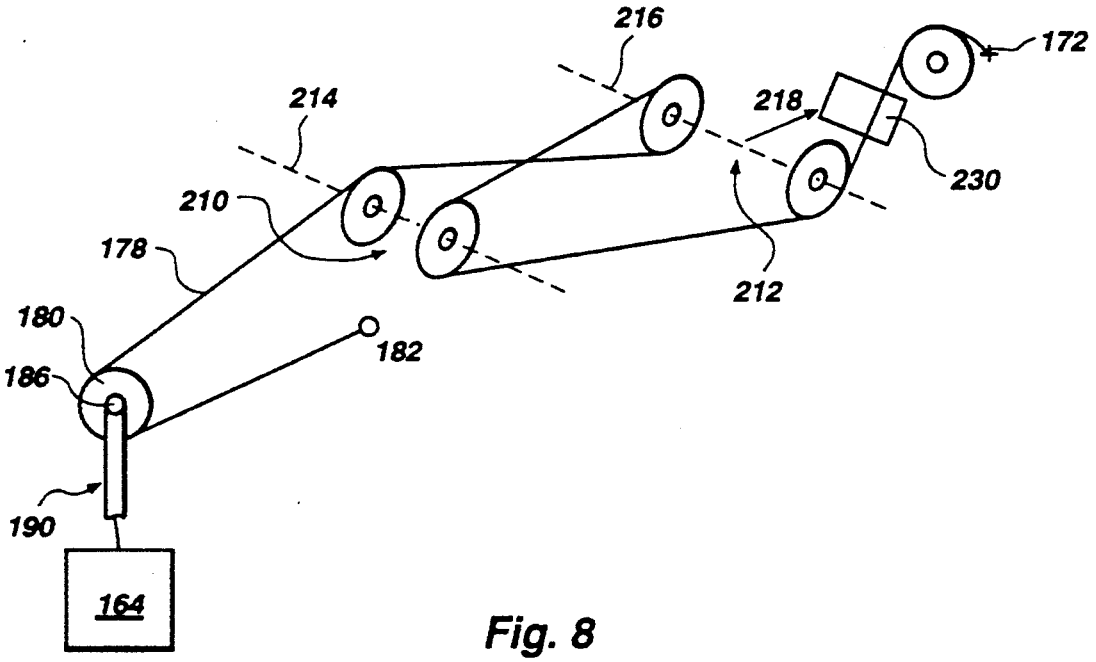

FIGS. 6 through 8 all illustrate modes of operation in which the cable end 146B is held against reverse travel by a cable stop 174 so that the pulley 148 functions as a traveling pulley to transmit effort applied at the axle 166 to the source 164. Referring to FIG. 6, a second continuous cable 178 is reeved through pulleys 180, 182 between the cable stop 172 and a permanent cable anchor 184.

As shown by FIGS. 7 and 8, a number of other components may be positioned between the pulley 180 and the cable stop 172, but when the stop 172 is engaged, these components may be ignored. The pulleys 148 and 180 are connected at their respective axles 166 and 186 by parallel links 188. Accordingly, any linear movement of the axle 186 effects a tandem movement of the axle 166, which movement is reflected by an equivalent movement of the axle 162 of the pulley 150. The assembly, designated generally 190, which includes pulleys 148 and 180 is moved in various ways by the operation of three different exercise devices, all as illustrated by the respective FIGS. 6, 7 and 8.

FIG. 6 illustrates third 192 and fourth 194 continuous cables, each of which is interconnected to similar components to fashion a "butterfly" exercise unit. The respective cables 192, 194 are connected at their respective first ends 192A, 194A, to opposite sides of a fixture 196 which straddles the pulley 182 to support opposite ends of the axle 198. The cable ends 192A and 194A are trained over similar pulleys 200, 202, as shown for connection to a butterfly apparatus of the type designated generally 52 in FIG. 1. Cable stops 204 and 206 are provided to prevent travel of the cables 192, 194 in the reverse direction. For purposes of the cable/pulley system as described by reference to FIGS. 7 and 8, the axle 198 of the pulley 182 is held static by the stops 204, 206 effectively functioning as an extension of the anchor 184 of the cable end 174A.

FIGS. 7 and 8 illustrate two utilizations of the complete system structured around the continuous cable 178. For simplicity, the system components between the moving assembly 190 and the resistance source 164 are omitted, having been described in detail in connection with other embodiments. Similarly, the cable end 178A is considered to be anchored at the axle 182, for the reasons explained in connection with FIG. 6. In any event, the cable 178 is reeved in a crossover arrangement around two double-pulley arrangements, indicated generally 210 and 212, respectively. The axle 214 for the assembly 210 is fixed. The axle 216 for the assembly 212 is capable of travel in the direction 218, but is otherwise restrained. The end 178B of the cable 178 is reeved over a terminating pulley 220. An exercise unit 225, typically a high pull bar or chain 226 (FIG. 1), may operate to pull the cable end 178B, but retraction of the cable 178 is prevented by the cable stop 172. As best shown by FIG. 8, an exercise unit 230 may function to move the axle 216 in the direction 218. The assembly 190 moves in response to operation of either of the units 225, 230. The load resistance at unit 225 will be twice that felt at unit 230, however.

Reference herein to details of the illustrated embodiments is not intended to restrict the scope of the appended claims which themselves are intended to define the invention as disclosed and its equivalents.

What is claimed is:

1. An exercise machine comprising:
a frame for positioning on a support surface;
a first guide attached to said frame;
a cable movably trained about said first guide for movement relative to said frame by a user in the performance of exercise; and
a resistance system secured to said frame means, said resistance system including:
a lever member rotatably mounted at a proximal end to said frame,
a second guide attached proximate the distal end of said lever member, said cable being trained about said second guide to move with respect thereto,
said lever member further including a curved member,
a moveable connector secured to said lever member to be continuously moveable along said curved member between a first position proximate said frame and a second position proximate said guide,
an adjustment member secured to said lever member and operably associated with said moveable connector for positioning said moveable connector intermediate said first position and said second position, and
a resistance mechanism rotatably secured at one end to said frame and to said moveable connector at the other end the distance between said one end and said other end being independent of the position of said moveable connector along said lever member.

2. The exercise machine of claim 1 wherein said resistance system includes movement means for moving said moveable connector.

3. The exercise machine of claim 2 wherein said movement means is an electric motor operable by the user and connected to said moveable connector by connector mover means.

4. The exercise machine of claim 3 wherein said connector mover means is a screw threadedly connected to said moveable connector.

5. The exercise machine of claim 2 wherein said resistance mechanism is a spring.

6. The exercise machine of claim 2 wherein said resistance mechanism is a gas shock absorber.

7. The exercise machine of claim 6 wherein said resistance mechanism is a pair of spaced apart gas shock absorbers.

8. The exercise machine of claim 6 wherein said first guide further comprises a block and tackle system.

9. The exercise machine of claim 3 further including a control console connected to an external source of power and to said motor to control operation thereof.

10. An exercise machine comprising:
frame means comprising:
a base for positioning on a support surface;
an upward member attached to said base and extending upwardly away therefrom;
a transverse member attached to said upward member to extend transversely thereto;
cable means attached to said transverse member to move with respect to said transverse member in the performance of exercise;
a resistance system secured to said frame, said resistance system including
a lever pivoted at a proximal end to said upward member and including a curved member,
a guide attached proximate the distal end of said lever, said cable means being trained around said guide to move with respect thereto;
a moveable connector secured to said lever to be continuously moveable along said curved member between a first position proximate said frame and a second position proximate said guide,
an adjustment member secured to said lever and contacting said moveable connector to position said moveable connector intermediate said first position and said second position, and
a resistance mechanism pivotably secured at one end to said frame and secured to said moveable connector at the other end, the length of said resistance member being independent of the position of said moveable connector along said lever.

11. The exercise machine of claim 10 wherein said cable means comprises at least one cable moveably secured to said transverse member and extending around said guide.

12. The exercise machine of claim 10 wherein said curved member is further comprised of a curved surface for guiding said moveable connector and for maintaining a distance between said one end and said other end of said resistance mechanism, said distance being independent of the position of said adjustment member.

13. An exercise machine comprising:
a frame;
a cable reeved to said frame for movement by a user in the performance of exercise;
a resistance system secured intermediate said cable and said frame, said resistance system comprising:
a lever rotatably mounted at a proximal end to said frame said lever further comprising a curved member,
a guide attached at the distal end of said lever member, said guide having said cable reeved therethrough,
a moveable connector secured to said lever to be continuously moveable along said curved member between a first position proximate said frame and a second position proximate said guide, and
a pneumatic resistance mechanism rotatably secured at one end to said frame and to said moveable connector at the other end, the position of said other end with respect to said one end being independent of the position of said moveable connector along said lever; and
a block and tackle system secured to said frame and interconnected to said cable and said guide for varying the mechanical advantage.

* * * * *